US005899626A

United States Patent [19]

Hatano et al.

[11] Patent Number: 5,899,626

[45] Date of Patent: May 4, 1999

[54] FILE FOLDER

[76] Inventors: Nobuaki Hatano, 9 Pinewood Cir., Wellesely, Mass. 02181; Hsieh Feng-Chuan, 11F-2, No. 378, Sec. 1, Wen Hsin Rd., Taichung, Taiwan

[21] Appl. No.: 08/896,909

[22] Filed: Jul. 18, 1997

[51] Int. Cl.[6] ..... B42F 3/00; B42F 15/00

[52] U.S. Cl. ..... 402/4; 229/672

[58] Field of Search ..... 402/4; 211/46; 312/184; 229/67.2, 67.3, 67.1, 67.4; 281/29, 32

[56] References Cited

U.S. PATENT DOCUMENTS

| | | | |
|---|---|---|---|
| 3,826,582 | 7/1974 | Podosek | 402/4 |
| 3,865,445 | 2/1975 | Dean et al. | 312/184 |
| 4,114,963 | 9/1978 | Menahem | 229/67.2 |
| 4,576,328 | 3/1986 | Snider | 229/67.1 |
| 4,979,626 | 12/1990 | Pitts | 211/45 |
| 5,048,697 | 9/1991 | Payne | 211/45 |
| 5,154,527 | 10/1992 | Blessing | 402/4 |
| 5,311,685 | 5/1994 | Wyant | 40/641 X |
| 5,328,259 | 7/1994 | Meriaux | 312/184 |
| 5,358,125 | 10/1994 | Blessing | 211/46 |
| 5,393,154 | 2/1995 | Hubbell | 402/4 |

*Primary Examiner*—Frances Han

[57] ABSTRACT

A file folder includes a first plate, a second plate and two side members. The first plate has three sequent portions defined in one of two ends thereof by three folded lines and two slots are defined in the first portions. The first is folded upwardly, the second portion is folded toward the other end of the first plate and the third portion is folded toward the first portion, wherein the second plate has one end thereof adhered to the third portion. Two side members each having a hook portion are respectively received between the second and the third portion, a protrusion extending from each one of the side members and slidably received in the respective slot so that the side members can be pulled laterally from the file folder to be hung on rods of a drawer.

3 Claims, 10 Drawing Sheets

FILE FOLDER

BACKGROUND OF THE INVENTION

1. Field of the Invention

The present invention relates to a folder and, more particularly, to an improved sliding hanging file folder having side members retractably disposed thereto so as to be hung on two rods in a drawer.

2. Brief Description of the Prior Art

Some conventional file folders has two protrusions extending laterally from two opposite sides thereof so as to be hung on two rods longitudinally disposed in a drawer so that a secretary may slidably shift the folders along the two rods and easily pick the folder he/she wants. However, the protrusions are fixedly disposed to the folders and which occupy too much space when the folders are used out of the drawer. Furthermore, the protrusions could interference papers or documents on a desk unintentionally and/or scrape an upper surface of the desk because the users are not used to use a file folder having two protrusions on desks. Therefore, the conventional file folders having two protrusions can only be used in drawers.

The present invention intends to provide an improved file folder having two side members retractably disposed thereto so as to mitigate and/or obviate the above-mentioned problems.

SUMMARY OF THE INVENTION

In accordance with aspect of the present invention, there is provided a file folder comprising a first plate, a second plate and two side members. The first plate has a first end and a second end which has a first, a second and a third folded line defined transversely therein so as to form a first portion located between the first and the second folded line, a second portion located between the second and the third folded line, and a third portion located between the third folded line and the second end of the first plate. The first portion has two slots defined therethrough. The first portion is folded upwardly along the first folded line and the second portion is folded downwardly along the third folded line and toward the first end of the first plate, the third portion folded along the third folded line and toward the second end of the first plate. The second plate has a first end securely inserted between the third portion and the first plate.

The two side members each are received between the second portion and the third portion and have a hook portion formed thereto. Each of the side members has a protrusion extending laterally from a first side thereof so that the protrusions are slidably inserted into the respective slots of the first plate.

It is an object of the present invention to provide a sliding hanging file folder having two slidable side members disposed in two opposite sides thereof.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
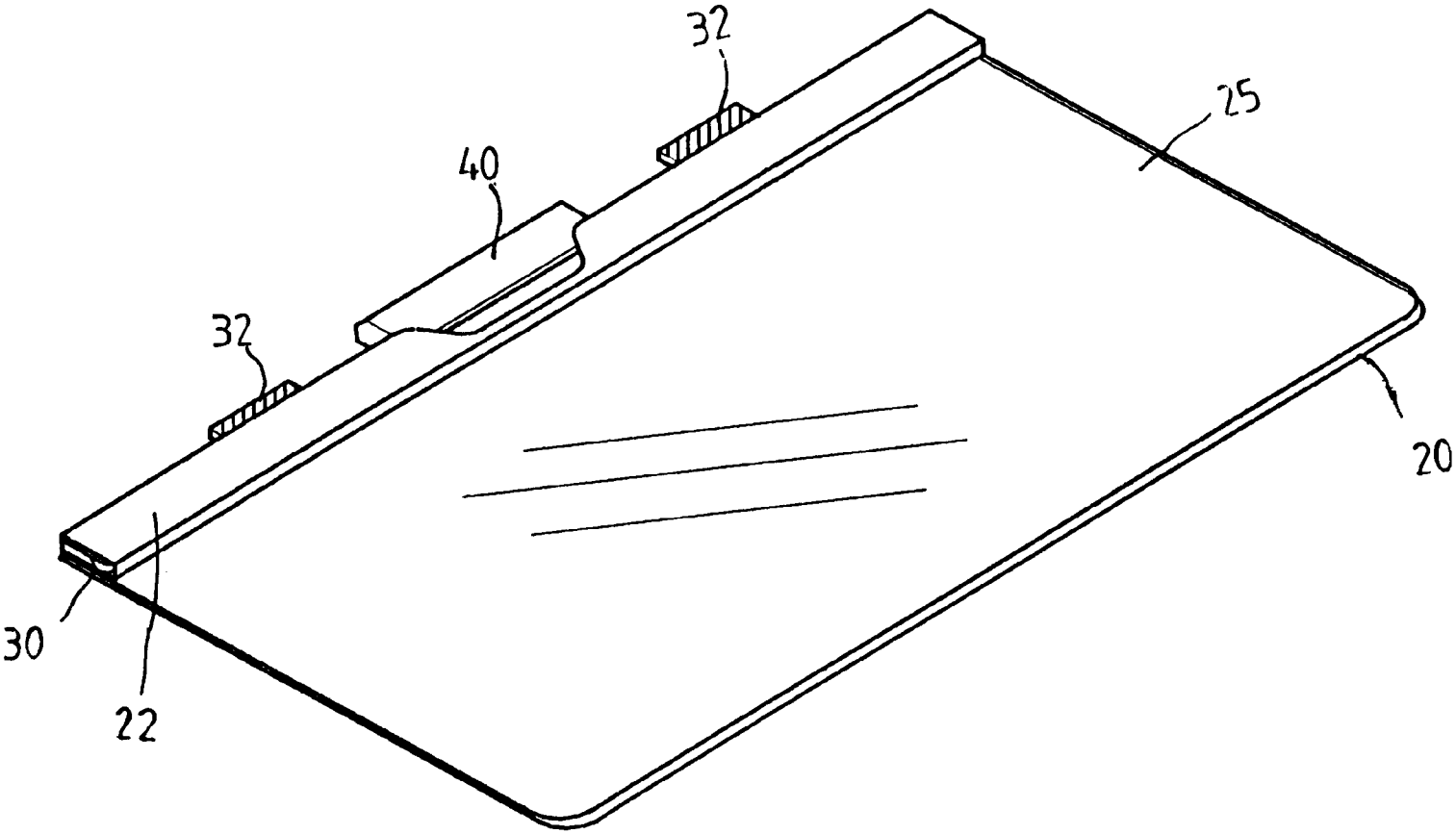
FIG. 1 is a perspective view of a file folder in accordance with the present invention.
Figure 2:
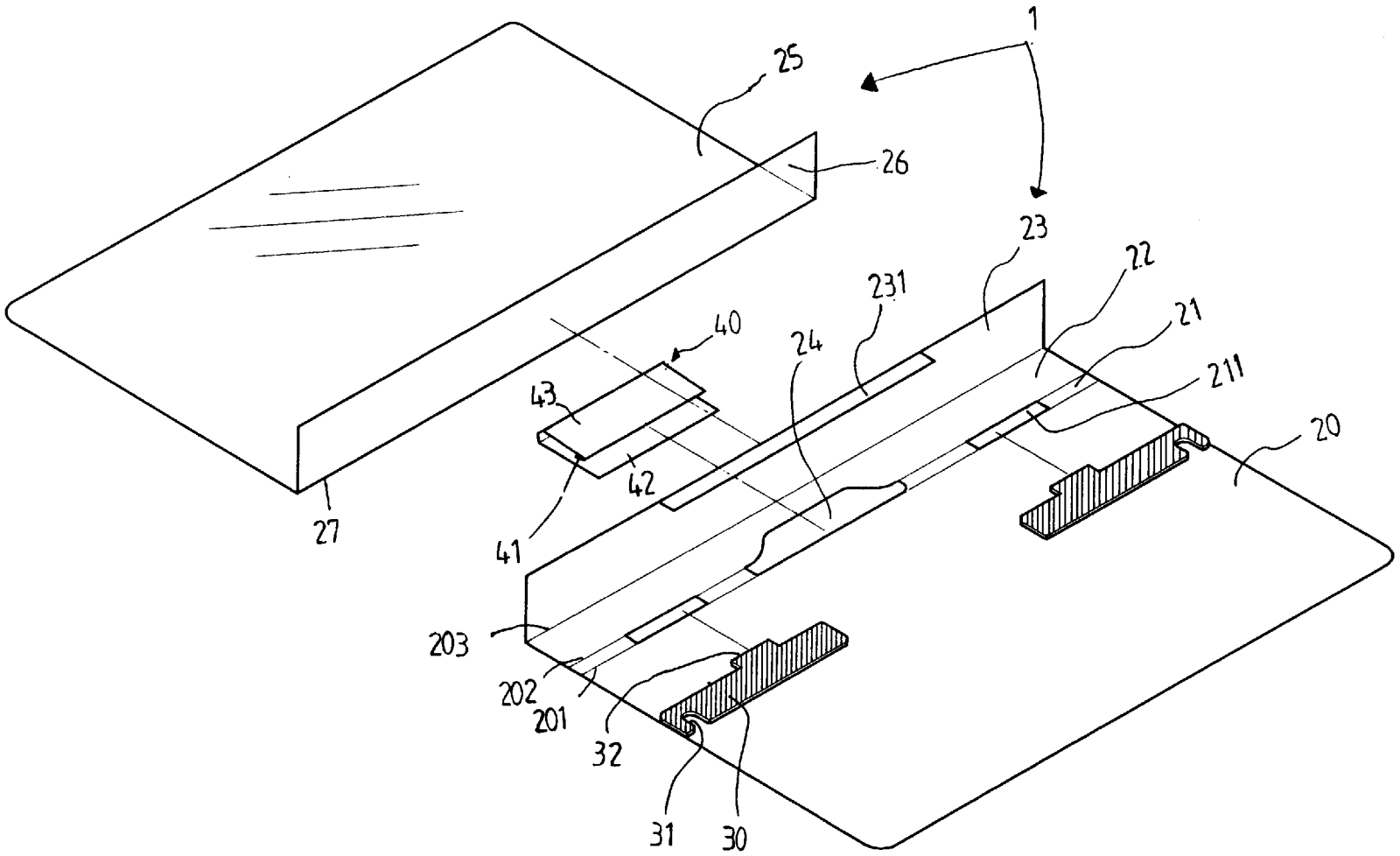
FIG. 2 is an exploded view of the file folder in accordance with the present invention.
Figure 3:
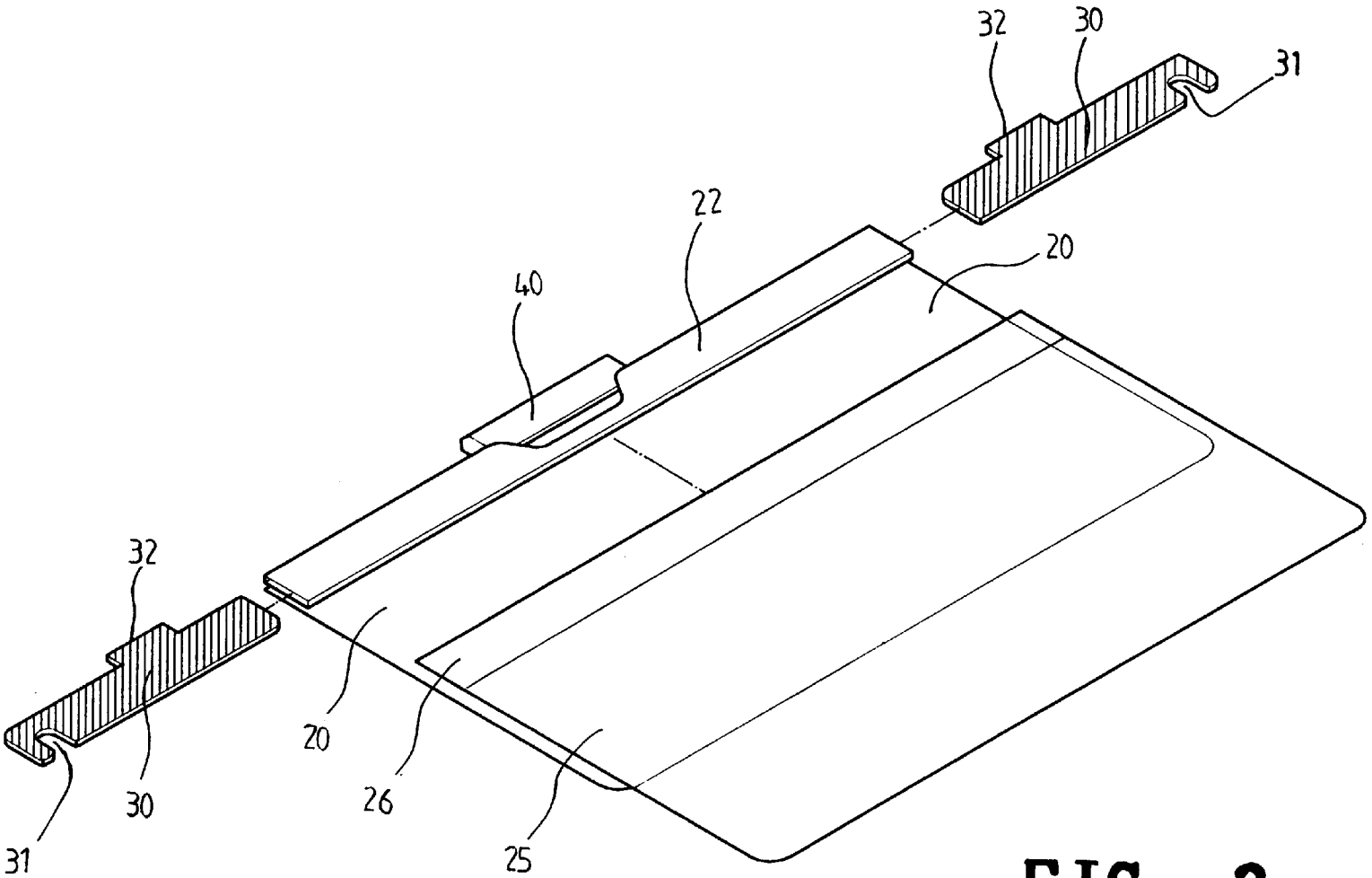
FIG. 3 is an exploded view of the file folder when the three portions of the first plate is folded.
Figure 4:
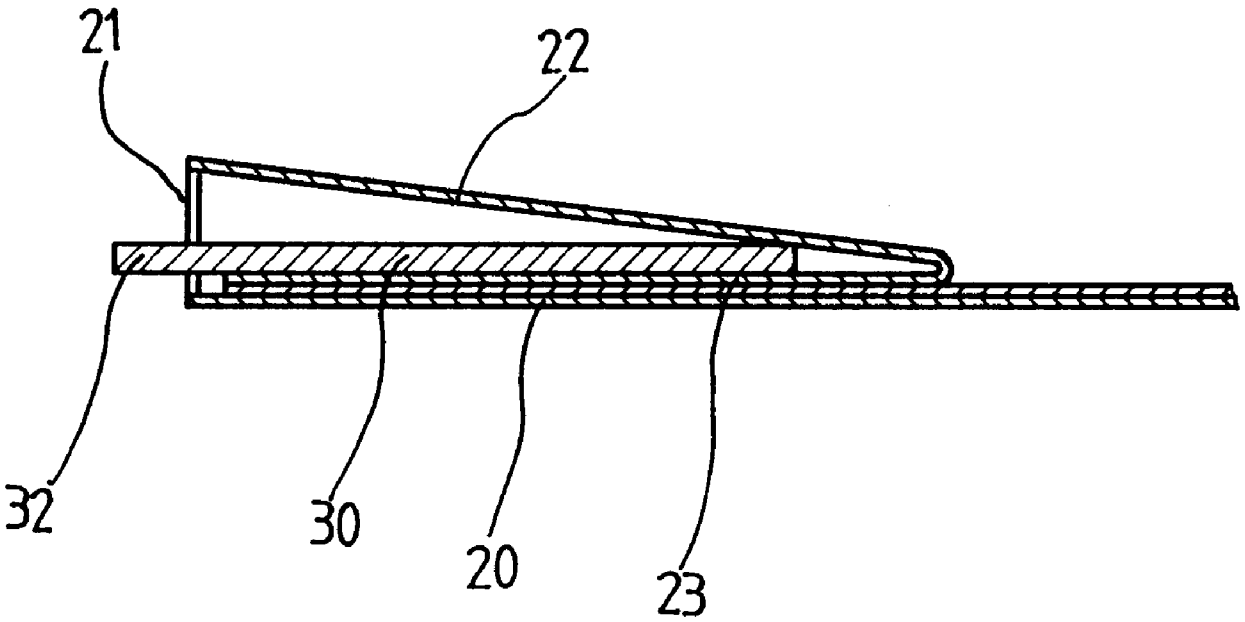
FIG. 4 is a side elevational view, partly in section, of the file folder and shows the location of a side member in the file folder.
Figure 5:
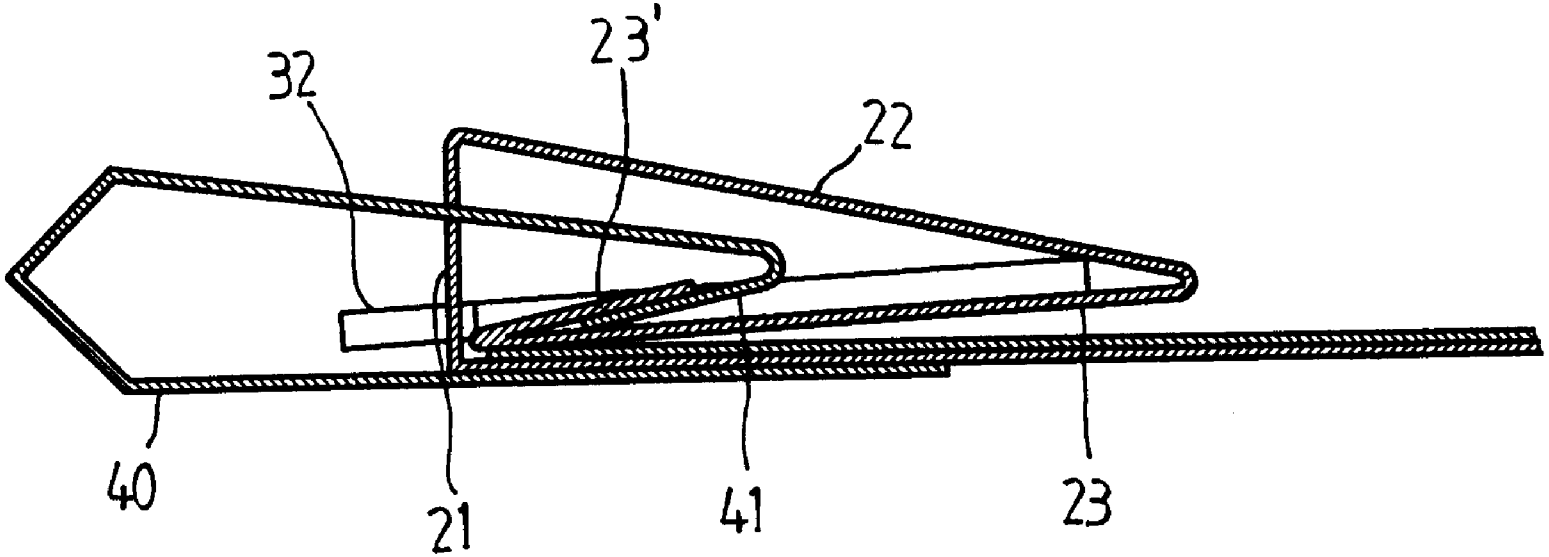
FIG. 5 is a side elevational view, partly in section, of the file folder and shows the location of a U-shaped member in the file folder.

Referring to the drawings and initially to FIGS. 1 through 5, a file folder in accordance with the present invention generally includes a first plate 20 having a first end and a second end which has a first, a second and a third folded line 201, 202, and 203 defined transversely therein so as to form a first portion 21 located between the first and the second folded line 201, 202, a second portion 22 located between the second and the third folded line 202, 203, and a third portion 23 located between the third folded line 203 and the second end of the first plate 20. The first portion 21 has two slots 211 defined therethrough and the two slots 211 are located on two opposite sides of the first plate 20. An opening 24 is defined in the first and the second portion 21, 22 and is located between the two slots 211. The third portion 23 has a first lip portion 231 foldably extending from the second end of the first plate 20.

The first portion 21 is folded upwardly along the first folded line 201 and the second portion 22 is folded downwardly along the third folded line 202 and toward the first end of the first plate 20, the third portion 23 folded along the third folded line 203 and toward the second end of the first plate 20. A second plate 25 has a first end having a fourth folded line 27 defined therein so as to define a fourth portion 26 which is securely inserted between the third portion 23 and the first plate 20.

A U-shaped member 40 has a first extending plate 42 fixedly connected to an under side of the first plate 20 and a second extending plate 43 extending through the opening 24, wherein the second extending plate 43 has a second lip portion 41 extending from a distal end thereof so as to be engaged between the first lip portion 231 and the third portion 23.

Two side members 30 each are received between the second portion 22 and the third portion 23 (FIG. 4), and have a first end with a hook portion 31 formed thereto and a second end. Each of the side members 30 has a protrusion 32 extending laterally from a first side thereof so that the protrusions 32 are slidably inserted into the respective slots 211 of the first plate 20.

Figure 6:
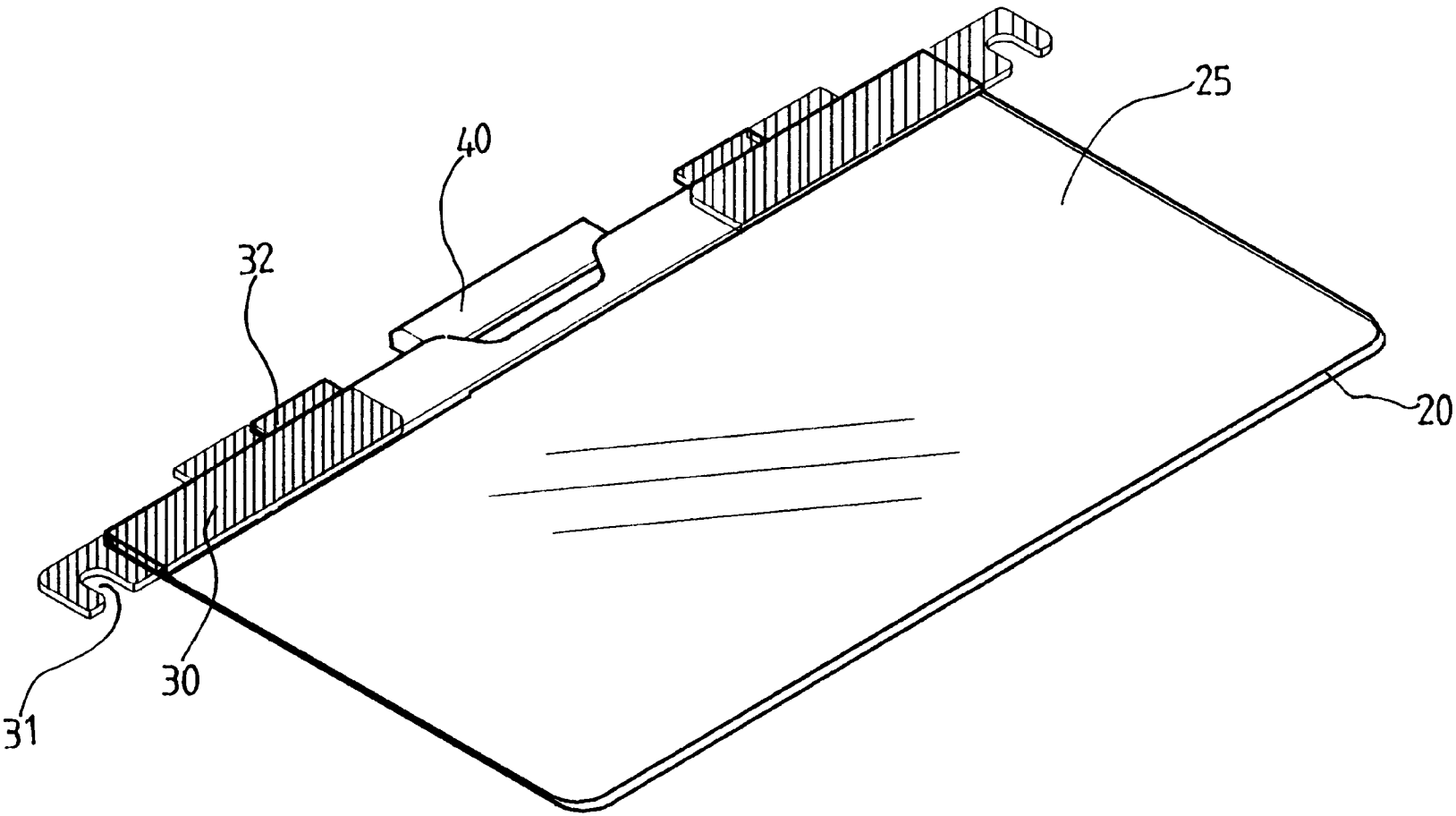
FIG. 6 is a perspective view of a file folder in accordance with the present invention to show the side members which are pulled from the file folder.
Figure 7:
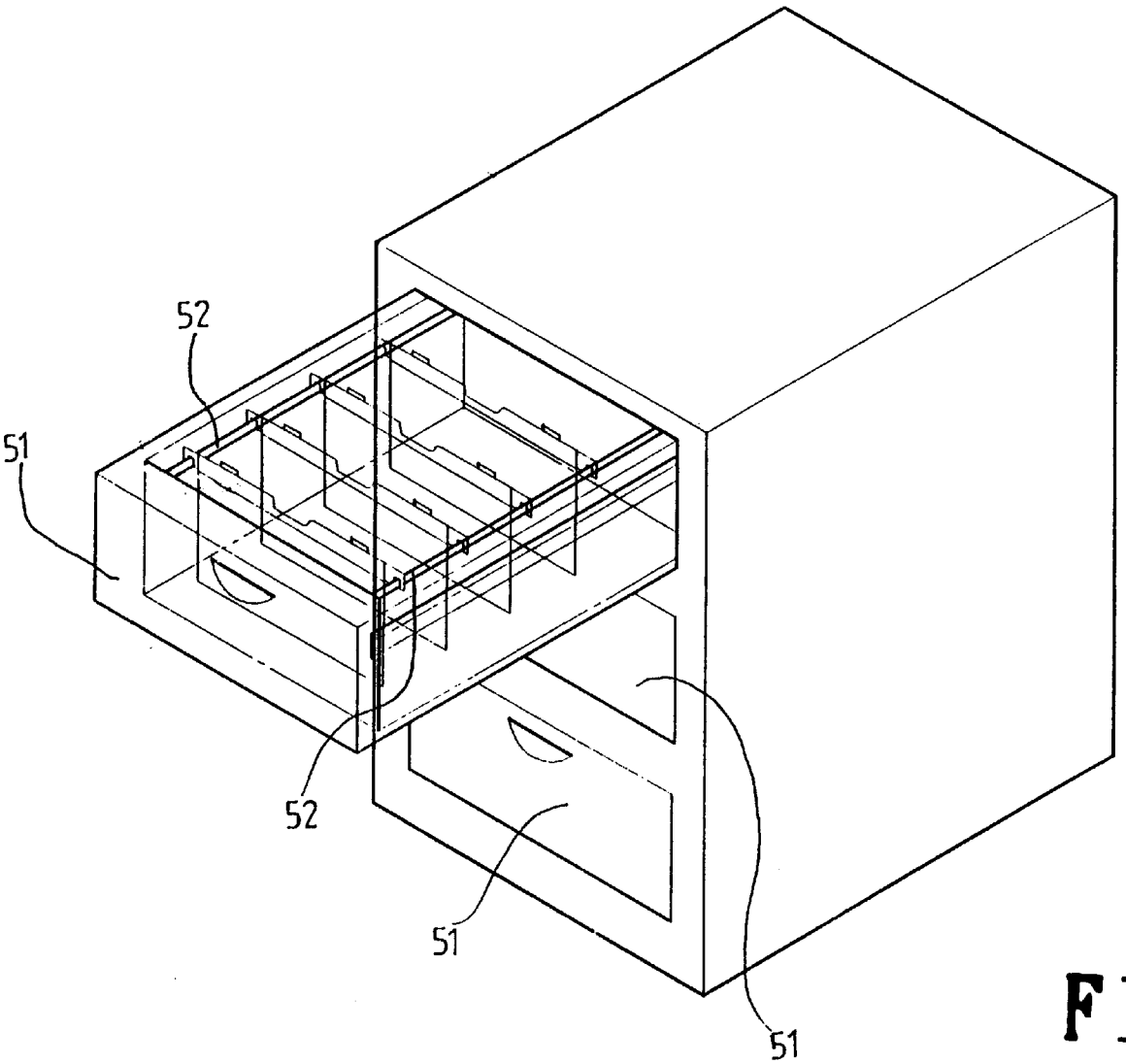
FIG. 7 is an illustrative view to show the file folders are hung on rods of a drawer.

Referring to FIGS. 6 and 7, the two side members 30 can be retractably received in the file folder and pulled from the two opposite sides of the file folder so that the two hook portions 31 are slidably hung on two rods 52 of a drawer 51.

Figure 8:
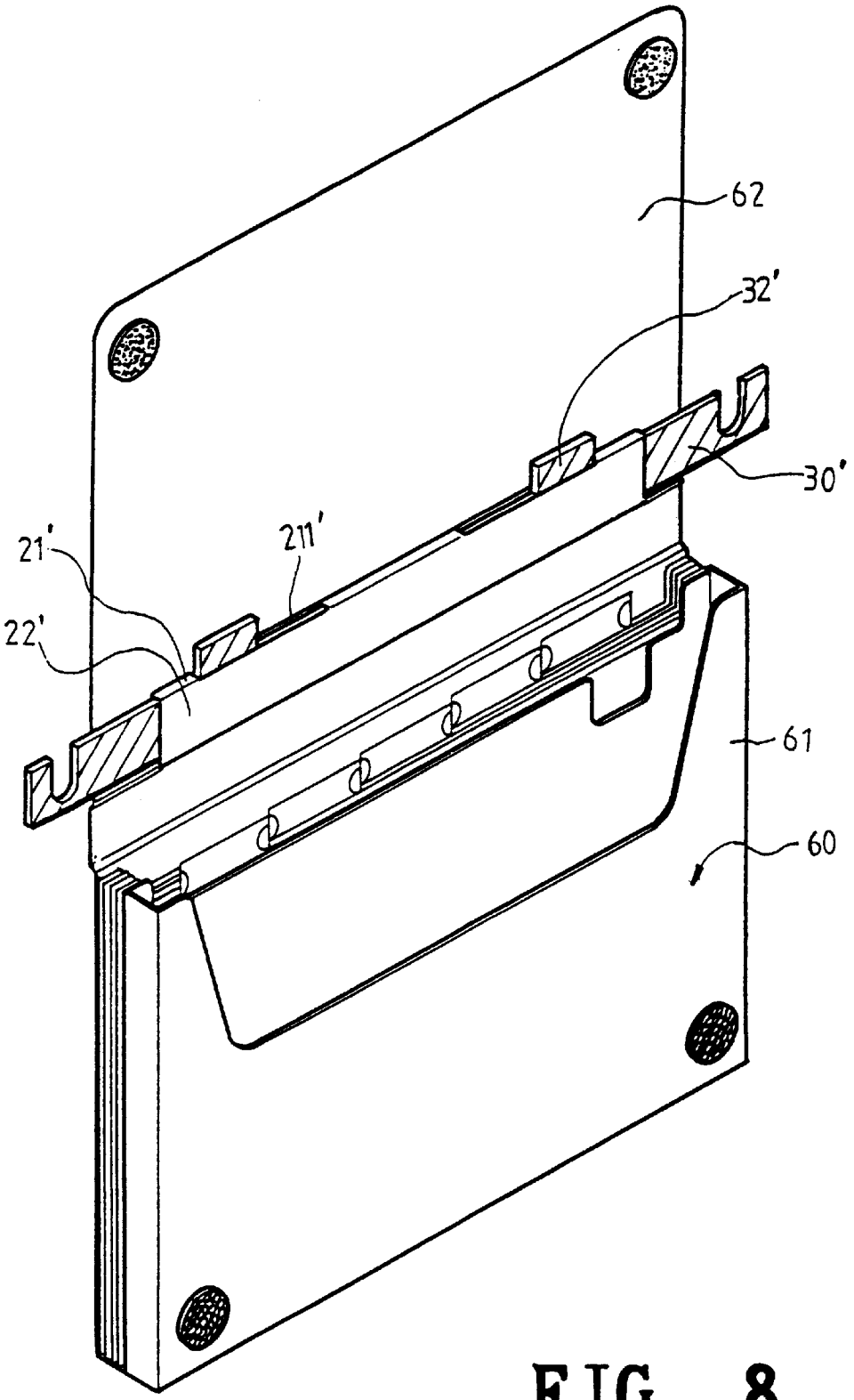
FIG. 8 is a perspective view of a first embodiment of the file folder in accordance with the present invention.
Figure 9:
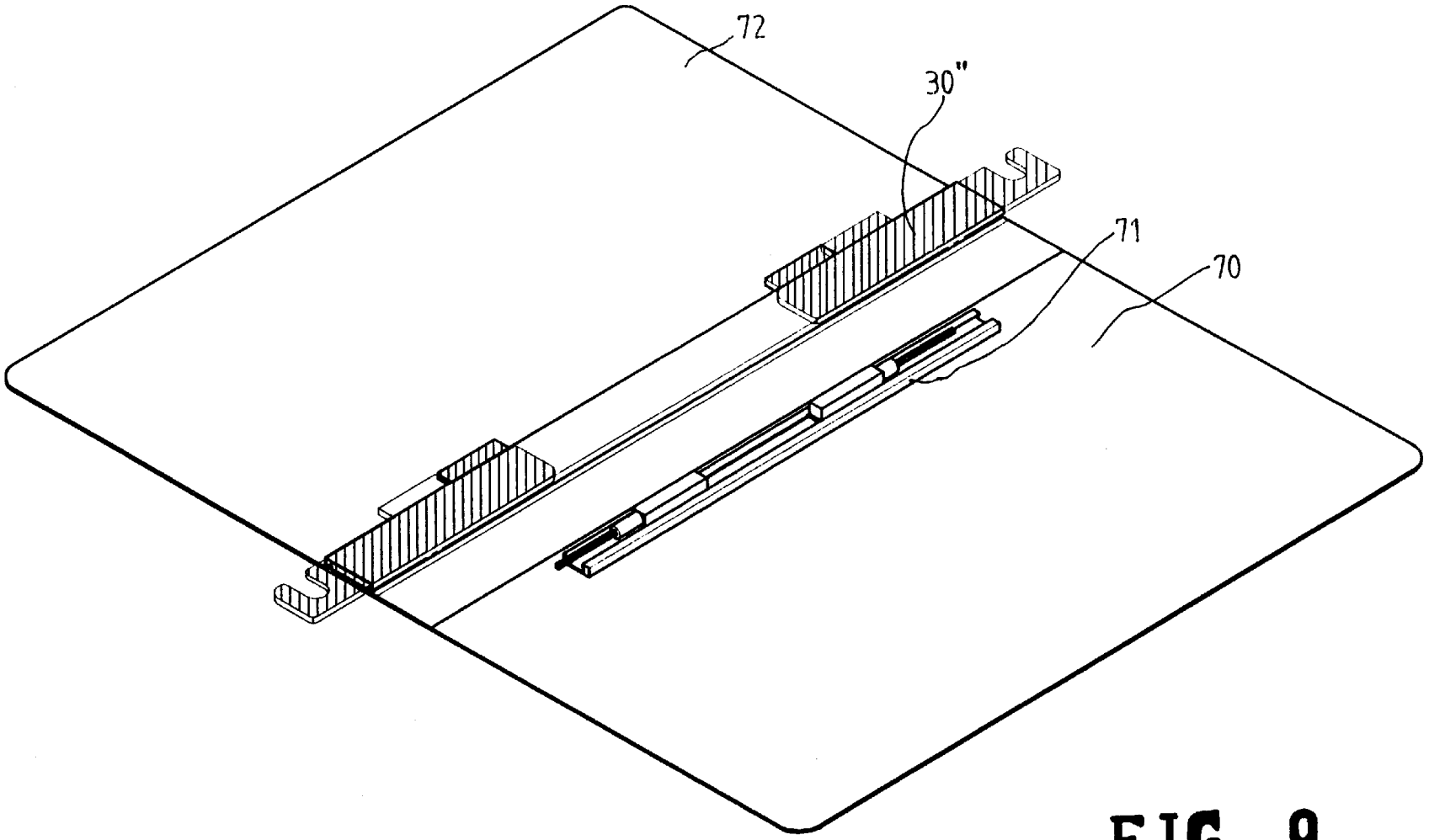
FIG. 9 is a perspective view of a second embodiment of the file folder in accordance with the present invention.
Figure 10:
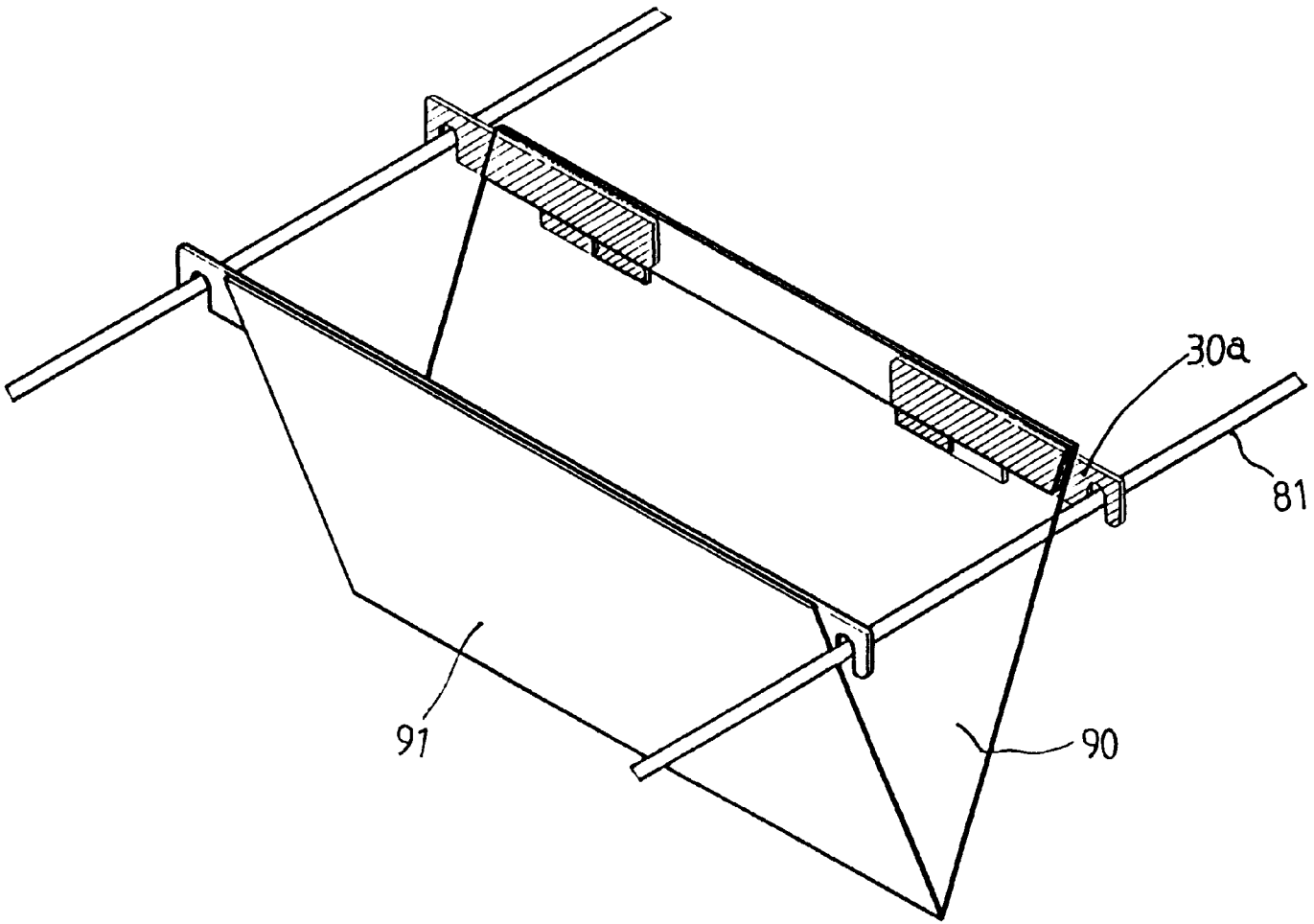
FIG. 10 is a perspective view of a third embodiment of the file folder in accordance with the present invention.

Referring now to FIGS. 8 through 10 which respectively show three embodiments of the present invention, wherein an expandable folder 60 (sliding hanging grip-lock) shown in FIG. 8 has a receiving portion 61 and a cover 62 which is foldably connected to the receiving portion 61. The cover 62 has one end thereof with three portions (only two portions 21', 22' are shown) which are folded as that shown in FIGS. 1 through 6 and two side members 30 are retractably received in the folded portions with their protrusions 32' slidably received in the slots 211'. FIG. 9 shows a simple file folder which has one plate 70 with a file fixing device 71 and the other plate 72 with the three portions and the side members 30". FIG. 10 shows a file folder hung on two rods 81 wherein the file folder has two foldable plates 90, 91 and each of the two plates 90, 91 has three portions and the two side members 30*a* so as to hung one the two rods 81 by the side members 30*a*.

Therefore, the present invention provides a sliding hanging file folder having two side members 30 retractably disposed in the file folder so that the two side members 30 can be pulled to hang on two rods in a drawer and received in the file folder when being picked from the drawer.

Although the invention has been explained in relation to its preferred embodiment, it is to be understood that many other possible modifications and variations can be made without departing from the spirit and scope of the invention as hereinafter claimed.

What is claimed is:

1. A file folder comprising:

a first plate having a first end and a second end which has a first, a second and a third folded line defined transversely therein so as to form a first portion located between said first and said second folded line, a second portion located between said second and said third folded line, and a third portion located between said third folded line and said second end of said first plate, said first portion having two slots defined therethrough, said first portion folded upwardly along said first folded line and said second portion folded downwardly along said third folded line and toward said first end of said first plate, said third portion folded along said third folded line and toward said second end of said first plate;

two side members each received between said second portion and said third portion, and having a first end with a hook portion formed thereto and a second end, each of said side members having a protrusion extending laterally from a first side thereof so that said protrusions are slidably inserted into said respective slots of said first plate, and a second plate securely connected to said first plate.

2. The file folder as claimed in claim 1 wherein an opening is defined in said first and said second portion and is located between said two slots, said third portion having a first lip portion foldably extending from said second end of said first plate and a U-shaped member having a first extending plate fixedly connected to an under side of said first plate and a second extending plate extending through said opening, said second extending plate having a second lip portion extending from a distal end thereof so as to be engaged between said first lip portion and said third portion.

3. The file folder as claimed in claim 1 wherein said second plate has a first end securely inserted between said third portion and said first plate.

* * * * *